US010415905B2

(12) United States Patent
Bubits

(10) Patent No.: US 10,415,905 B2
(45) Date of Patent: Sep. 17, 2019

(54) PISTOLS HAVING A LOCKING BLOCK

(71) Applicant: FORJAS TAURUS S.A., São Leopoldo (BR)

(72) Inventor: Wilhelm Bubits, Lutzmannsburg (AT)

(73) Assignee: FORJAS TAURUS S.A., São Leopoldo (BR)

( * ) Notice: Subject to any disclaimer, the term of this patent is extended or adjusted under 35 U.S.C. 154(b) by 0 days.

(21) Appl. No.: 15/548,588

(22) PCT Filed: Feb. 9, 2016

(86) PCT No.: PCT/AT2016/050024
§ 371 (c)(1),
(2) Date: Aug. 3, 2017

(87) PCT Pub. No.: WO2016/127194
PCT Pub. Date: Aug. 18, 2016

(65) Prior Publication Data

US 2018/0031341 A1 Feb. 1, 2018

(30) Foreign Application Priority Data

Feb. 9, 2015 (AT) ..... 59/2015

(51) Int. Cl.
*F41A 3/14* (2006.01)
*F41A 3/12* (2006.01)
*F41C 3/00* (2006.01)

(52) U.S. Cl.
CPC ..... *F41A 3/14* (2013.01); *F41A 3/12* (2013.01); *F41C 3/00* (2013.01)

(58) Field of Classification Search
CPC ..... F41A 3/14; F41A 17/36; F41C 3/00
(Continued)

(56) References Cited

U.S. PATENT DOCUMENTS 747,585 A * 12/1903 Browning ..... F41A 17/64 42/7
3,110,223 A * 11/1963 Schlappich ..... F41A 3/12 42/7

(Continued)

FOREIGN PATENT DOCUMENTS

| | | | |
|---|---|---|---|
| AT | 507219 | A4 | 3/2010 |
| DE | 29924790 | U1 | 8/2005 |
| DE | 202004009229 | U1 | 11/2005 |

OTHER PUBLICATIONS

International Search Report from International Patent Application No. PCT/AT2016/050024, dated Mar. 31, 2016.

(Continued)

*Primary Examiner* — Joshua E Freeman
*Assistant Examiner* — Bridget A Cochran
(74) *Attorney, Agent, or Firm* — Greer, Burns & Crain, Ltd.

(57) ABSTRACT

A pistol is provided, on the plastic housing of which a sliding carriage containing the barrel is guided in the longitudinal direction, which housing has a trigger guard at the transition to a grip stock, and in which housing a locking block is arranged; for an especially light embodiment that is simple to manufacture and nevertheless robust, the locking block forms a unit with the guiding elements of the sliding carriage, which unit is arranged in front of the magazine well and extends forward as far as the trigger guard, as a result of which the guide length is shortened. The locking block is fixed in the housing by a front cross pin and a rear cross pin and accommodates a locking bolt approximately over the second cross pin.

8 Claims, 4 Drawing Sheets

(58) Field of Classification Search
USPC ..... 42/7
See application file for complete search history.

(56) References Cited

U.S. PATENT DOCUMENTS 3,411,407 A * 11/1968 Pachmayr ..... F41A 3/64 89/196
3,728,939 A * 4/1973 Wilhelm ..... F41A 3/64 42/75.01
3,956,967 A * 5/1976 Martz ..... F41A 3/50 89/175
4,290,220 A * 9/1981 Ruger ..... F41C 23/00 42/71.01
4,463,655 A * 8/1984 Krieger ..... F41C 27/00 89/196
4,539,889 A * 9/1985 Glock ..... F41A 5/04 89/147
4,594,935 A * 6/1986 Smith ..... F41A 17/36 42/75.02
4,602,450 A * 7/1986 Hoenig ..... F41A 21/487 42/75.02
4,703,826 A * 11/1987 Byron ..... F41A 5/24 89/188
4,709,497 A * 12/1987 Resca ..... F41A 21/32 42/7
5,149,898 A * 9/1992 Chesnut ..... F41A 9/65 42/69.01
5,179,233 A * 1/1993 du Plessis ..... F41A 15/16 42/69.02
5,272,957 A * 12/1993 Chesnut ..... F41A 9/65 42/69.03
5,293,708 A * 3/1994 Strayer ..... F41A 9/70 42/7
5,343,650 A * 9/1994 Swan ..... F41C 23/16 42/117
5,406,731 A * 4/1995 Stevens ..... F41C 23/10 42/71.02
5,586,545 A * 12/1996 McCaslin ..... F41B 11/62 124/70
5,669,169 A * 9/1997 Schmitter ..... F41A 3/66 42/75.01
6,234,059 B1 * 5/2001 Fuchs ..... F41A 3/66 89/195
6,260,301 B1 * 7/2001 Aigner ..... F41A 3/66 42/71.02
6,401,379 B1 * 6/2002 Moon ..... F41A 3/66 42/71.01
6,694,658 B1 * 2/2004 Marsac ..... F41B 7/006 124/16
6,789,342 B2 * 9/2004 Wonisch ..... F41A 3/64 42/70.02
6,862,829 B2 * 3/2005 McMoore ..... F41A 17/46 42/70.07
6,993,864 B1 * 2/2006 O'Clair ..... F41A 3/14 42/71.02
7,117,623 B2 * 10/2006 Moore ..... F41A 3/66 42/71.02
7,219,463 B2 * 5/2007 Wossner ..... F41A 3/72 42/70.11
7,380,362 B2 * 6/2008 Curry ..... F41A 15/14 42/25
7,389,719 B2 * 6/2008 Curry ..... F41A 25/22 42/14
7,392,611 B2 * 7/2008 Curry ..... F41A 11/00 42/106
7,472,507 B2 * 1/2009 Curry ..... F41A 19/15 42/14
7,500,327 B2 * 3/2009 Bubits ..... F41A 17/72 42/69.02
7,506,469 B2 * 3/2009 Poulin ..... F41A 11/02 42/71.02
7,600,340 B2 * 10/2009 Curry ..... F41A 17/02 42/70.01
7,617,628 B2 * 11/2009 Curry ..... F41A 19/28 42/70.02
7,694,449 B1 * 4/2010 Pontillo, II ..... F41A 3/26 42/71.02
7,703,230 B2 * 4/2010 Curry ..... F41A 17/72 42/70.01
7,886,468 B1 * 2/2011 Pontollo, II ..... F41A 3/26 42/50
8,132,496 B2 * 3/2012 Zukowski ..... F41A 17/66 42/70.01
8,286,541 B2 * 10/2012 Lorenzut ..... F41A 5/12 89/189
8,438,768 B2 * 5/2013 Kallio ..... F41A 17/46 42/70.02
8,485,086 B2 * 7/2013 Alis ..... F41A 3/10 89/196
8,522,471 B2 * 9/2013 Settles ..... B32B 15/01 42/106
8,528,243 B1 * 9/2013 Glock ..... F41A 3/66 42/75.02
8,695,262 B2 * 4/2014 O'Clair ..... F41A 11/02 42/71.02
8,935,871 B2 * 1/2015 Bardy ..... F41A 19/14 42/69.03
8,950,100 B2 * 2/2015 Nebeker ..... F41A 3/64 42/108
9,927,200 B2 * 3/2018 Kuracina ..... F41A 19/30
2005/0034345 A1 * 2/2005 Beretta ..... F41A 19/44 42/69.03
2008/0263926 A1 * 10/2008 Bubits ..... F41A 17/72 42/69.02

OTHER PUBLICATIONS

Written Opinion from International Patent Application No. PCT/AT2016/050024, dated Jan. 5, 2017.

* cited by examiner

PISTOLS HAVING A LOCKING BLOCK

BACKGROUND

The invention relates to a pistol having a plastic housing, on which a sliding carriage containing a barrel is guided in the longitudinal direction, which housing has a trigger guard at the transition to a grip stock, and in which housing a locking block is arranged.

In the case of known pistols having a housing of plastic, such as for example the pistol by Glock, the metal parts for guiding the sliding carriage and the locking and accommodating of parts of the trigger are injection molded. The positionally accurate insertion of the metal parts into the injection mold is labor-intensive and does not ensure a product which is true to size, because the inserts can be displaced by means of the plastic which is injected into the mold at high pressure. A subsequent mechanical processing is frequently required.

From AT 254 752 T, it is known to accommodate the guide and parts of the trigger in a multifunction part which extends along the larger portion of the length of the pistol to behind the magazine well. The production of the multifunction part is cost-extensive and due to its length, the thermal expansion thereof must be considered when selecting the tolerances.

It is now an object of the invention to be able to produce the unit consisting of locking block and guide of the sliding carriage in a simple manner.

SUMMARY

For this purpose, it is particularly provided that the locking block forms a unit with the guide of the sliding carriage, which unit is arranged in front of the magazine well and extends forward approximately as far as the trigger guard. The guide is thus reduced to the length of the locking block. Guide elements at the front and at the rear end of the housing are thus no longer necessary. The short locking block can be positioned and fastened in the housing in a highly accurate manner and with a few hand movements and a post-processing is not required. Furthermore the grooves in the sliding carriage can thus be shorter, which significantly reduces the processing costs. The locking block consists in particular of plastic.

This solution is remarkable insofar as it breaks with the well-established teaching that an accurate guide requires a largest possible guide length. Due to the fact that only small vertical forces are to be transferred due to the position of the guide grooves in the sliding carriage, the advantage of the more precise guide, which can be attained in this way, prevails.

In a practical embodiment, the locking block is fixed in the housing by means of a first, front cross pin and a second, rear cross pin, and accommodates a locking bolt approximately above the second cross pin. The cross pins extend through the housing and permit a simple and accurate assembly of the locking block and of the guide. This accuracy does not only benefit the function, but also the guide of the sliding carriage. In response to locking and unlocking, the locking bolt cooperates with a lug on the barrel. It extends through the locking block, which is anchored in the housing.

In the case of a system having an unlocked lock, the locking bolt can serve as stable stop for a barrel. This also applies to positive lockings by means of rollers.

The locking block has a deep depression which extends in the longitudinal direction, in which there is room for the lug on the underside of the sliding carriage and through which the locking bolt passes. A useful detail is that the locking bolt is supported on the rear wall of the locking block. The locking bolt is thus subjected to less stress.

In a preferred embodiment, the unit comprising the locking block and the guide of the sliding carriage consists of the actual locking block and of a guide plate each on both sides, which is connected to the locking block and the housing by means of the first cross pin and the locking bolt. The mold of the locking block thus becomes simpler and the guide plates can be produced as simple stamped parts with the required precision. The production of this unit thus becomes significantly cheaper. The separation of the guide plates from the locking block also allows for the free selection of the materials, according to the different stability requirements. The guide plates, together with the locking block, are fixed by means of the cross pins or the locking bolt, respectively, thus do not need their own fastening elements. This further simplifies the production and assembly.

To embody the guide elements, which engage with the grooves of the sliding carriage, the guide plates have claws which are bent into the horizontal close to their front and rear end and which are directed to the outside. They can be bent in one operating step with the stamping.

Thanks to the position and the claws at a smaller distance than common guides (from the front to the rear end of the housing), the guide grooves need to extend only along a portion of the length of the sliding carriage, which shortens the machining time with a precision milling machine. For the purpose of assembling the sliding carriage on the guide, the grooves thereof each have apertures, which are open to the bottom, at two locations, wherein the length and the distance of the apertures from one another correspond to the length and the distance of the claws of the guide plates.

The position of the apertures in the guide grooves of the sliding carriage correspond to the assembly position thereof, which is located in front of the operational position by the length of the apertures. The sliding carriage thus only needs to be placed onto the housing from the top and be displaced to the rear by the length of the claws, until a dismounting lever engages with the corresponding recess.

An advantageous further development is that the guide plates are inserted into depressions in the side walls of the locking block. They are thus inserted into the locking block with a positive fit. The positive fit creates additional power transfers and facilitates the assembly.

From case to case, it can be advantageous to provide an additional lateral guide for the sliding carriage. The guide plates between the front and the rear claw then each have a tab which is directed upward. These tabs abut on the vertical inner wall of the sliding carriage. This case can occur, for example, when the claws do not reach to the base of the grooves.

The freedom in the material selection, which is obtained by the separation of the guide elements from the actual locking block, can be used to produce the latter of a different material, in particular of a suitable plastic. Suitable means that the plastic must have the required stability and impact resistance, and, if possible, also has a dampening effect. The latter increases the comfort for the shooter. Initially, the use of a plastic in a locking block of a pistol appeared to be absurd. However, tests have shown that this is quite possible thanks to the invention and that no noteworthy wear appears even in the case of long test series. An aramid, which is reinforced with glass fibers, has particularly proven itself.

BRIEF DESCRIPTION OF THE DRAWINGS

In the following, the invention will be discussed in more detail by means of preferred exemplary embodiments, which are illustrated in the drawing. Therein.

DETAILED DESCRIPTION

Figure 1:
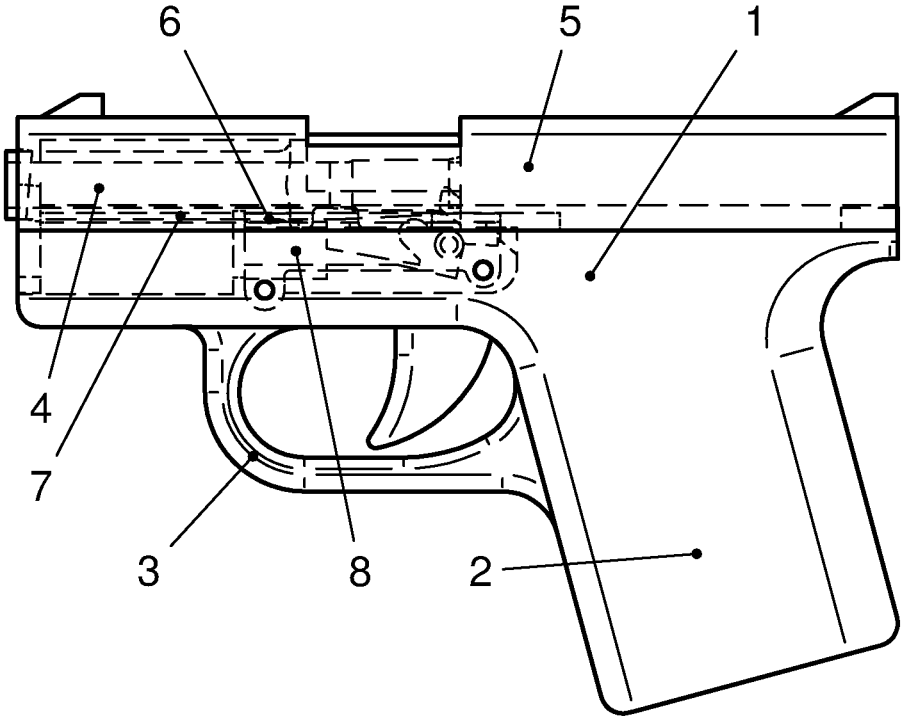
FIG. 1 shows an exemplary embodiment of the pistol according to the invention in outer view.

In FIG. 1, a pistol housing consisting of plastic is identified with 1, the grip stock thereof is identified with 2 and the trigger guard thereof is identified with 3. A sliding carriage 5, which accommodates a barrel 4, is guided on the housing 1 in the longitudinal direction. The housing-fixed guide elements 6 of said sliding carriage and corresponding guide grooves 7 in the sliding carriage 5 are only suggested here, because they are described in detail below; in the same manner as a locking block 8. The grip stock 2 includes a non-illustrated magazine compartment.

Figure 2:
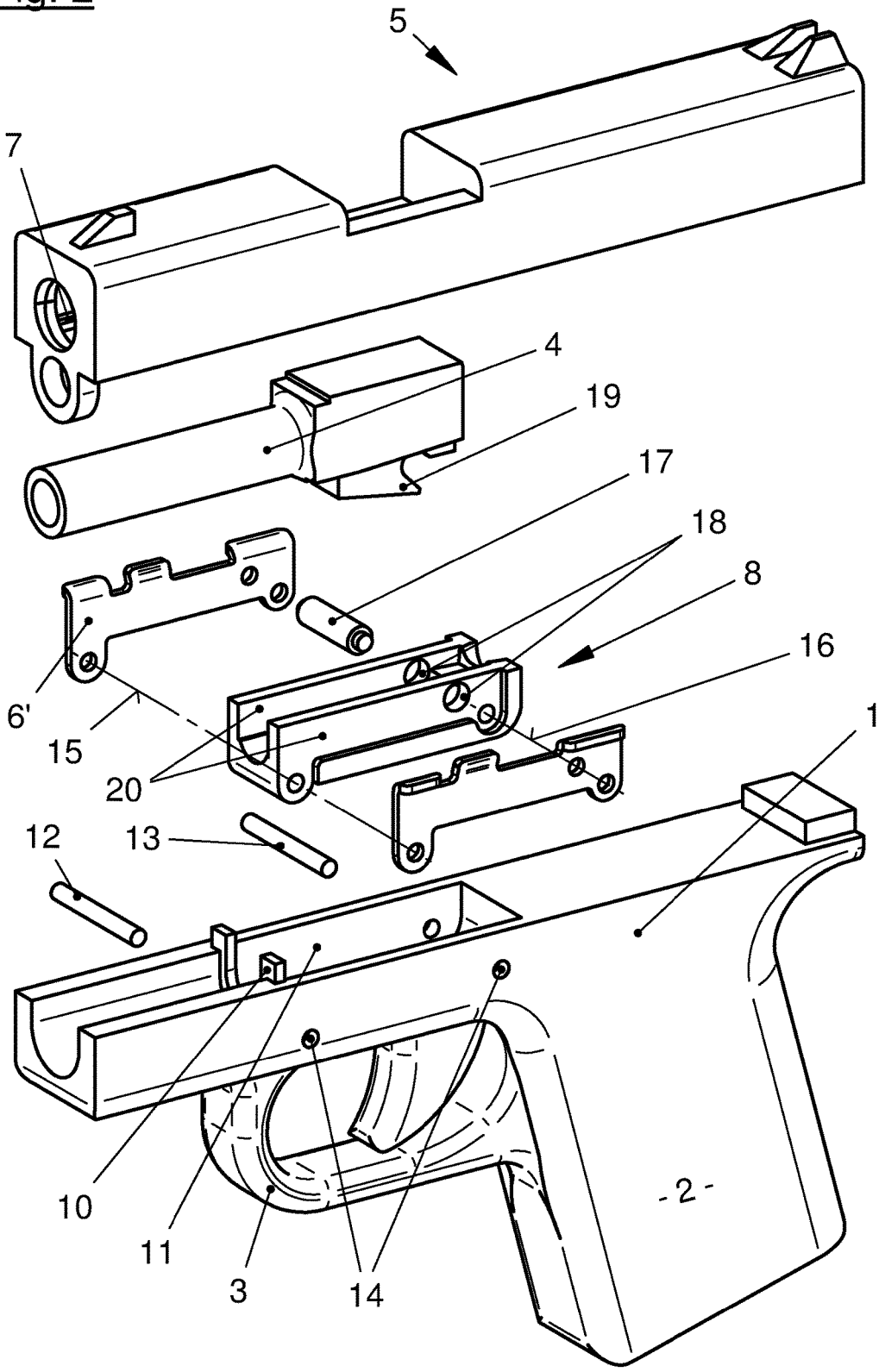
FIG. 2 shows an exploded illustration of FIG. 1.

Several details can be seen in FIG. 2. A space 11 for accommodating the unit consisting of the locking block 8 and the guide elements 6, 6', which are separate here, is present in the housing 1 behind a stop 10 for the sliding carriage 5. Together, they take up the entire width of the space 11. This unit is fixed in the housing 1 by means of cross pins 12, 13, which extend through bores 14, 15 and 16. The length of the locking block 8 is approximately identical to the length of the trigger guard 3. In front of it, there is room for a non-illustrated return spring. A locking bolt 17 is transversely located in bores 18 in the side walls 20 of the locking block 8 at right angles. Said locking block cooperates in the known manner with a lug 19 on the underside of the barrel 4. A depression as clearance 21 for the lug 19 is located between the side walls 20. The guide elements 6 are plates 6' which abut on the locking block 8 on the one side and on the inner walls of the housing 1 on the other side.

Figure 3:
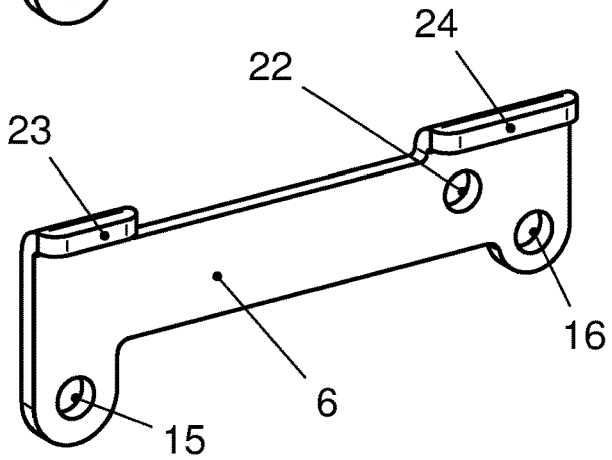
FIG. 3 shows a detail of a guide element according to FIG. 2.

FIG. 3 shows such a guide element 6 or plate 6', respectively, in an enlarged manner. It is a stamped part of a flat basic shape of a very hard or hardened plate having, on its upper edge, a first (23) and a second (24) claw 23, 24, which is bent outwards at a right angle. These claws 23, 24 engage with guide grooves 7 of the sliding carriage 5. To be fastened in the housing 1, the cross pins 12, 13 extend through the bores 15, 16. Smaller bores 22 accommodate ends of the locking bolt 17.

Figure 4:
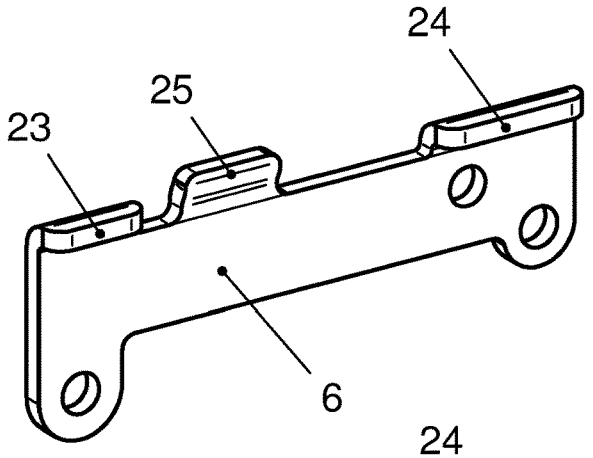
FIG. 4 shows an alternative of FIG. 3.

As alternative, FIG. 4 shows a tab 25 which is directed upward between the two claws 23, 24 and which can provide an additional lateral guide in cooperation with the inner walls of the sliding carriage 5.

Figure 5:
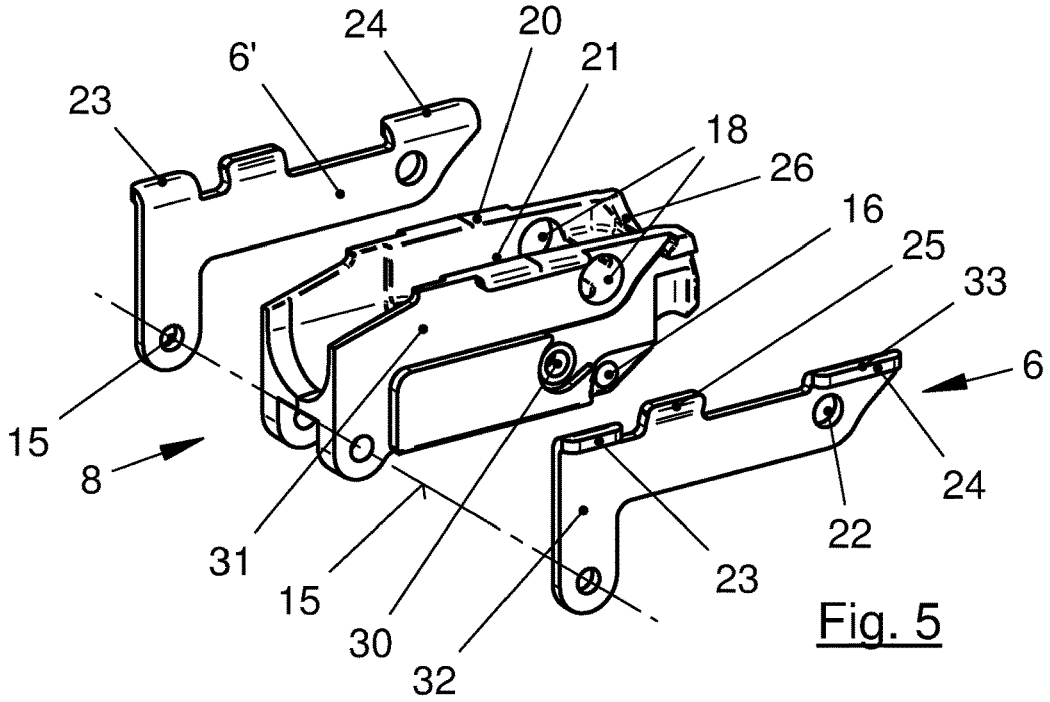
FIG. 5 shows a detail of the guide elements and guide grooves according to FIG. 2 (parts in a design close to the embodiment)

FIG. 5 shows the locking block 8 with all details. The guide elements or plates 6, respectively, and 6', respectively, could simply abut on the outer wall of the locking block 8. However, they are inserted with a positive fit into recesses 31 in the side walls of the locking block 8 here. The guide plates 6 or 6', respectively, are embodied here as angle plates having a vertical leg 32 and a horizontal leg 33. The locking block 8 can thus take up the full width of the room 11 in the housing 1. More room is also available for further functional installations in the interior of the locking block 8. These functional installations could be, e.g., a non-illustrated trigger mechanism having springs and a carriage catch lever. Only one functional bore 30 can be seen in FIG. 5. A clearance 21, which ends with the rear at a rear wall 26, is located between the side walls 20. The locking bolt 17 is supported on this rear wall 26.

Figure 6:
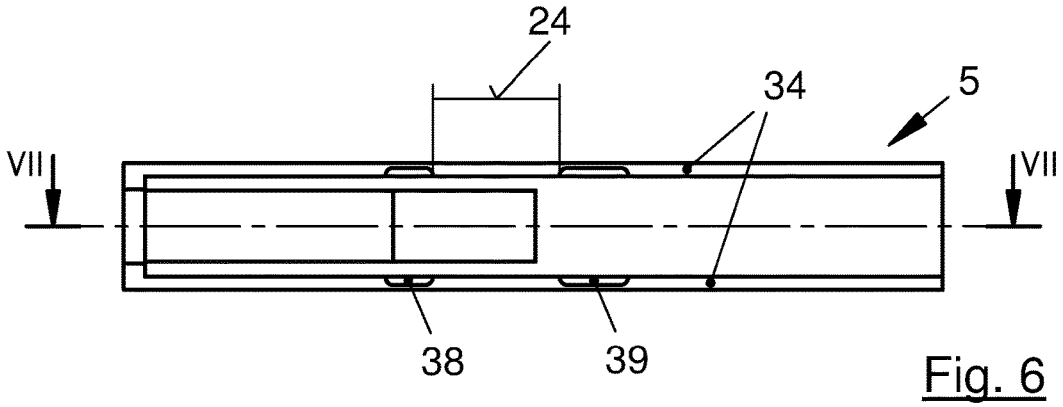
FIG. 6 shows a sliding carriage, seen from below.
Figure 7:
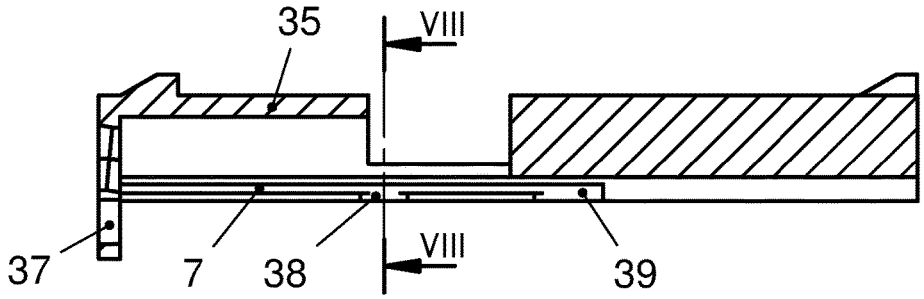
FIG. 7 shows a longitudinal section according to VII-VII in FIG. 6.
Figure 8:
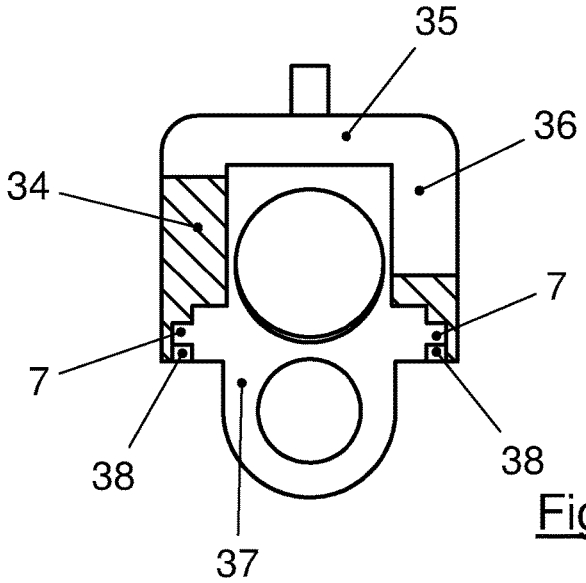
FIG. 8 shows a cross section according to VIII-VIII in FIG. 7, enlarged.

The sliding carriage 5 with its guide grooves 7 can be seen in FIGS. 6, 7 and 8. In its basic shape, it is a hollow cuboid having side walls 34 and a cover wall 35, which is interrupted by an ejection window 36. It ends in the front in spectacles 37 and includes a non-illustrated striking mechanism in its rear half. The guide grooves 7 are milled out close to the lower edge of the side wall 34. However, they do not extend across the entire length of the sliding carriage 5, as usual, wherein the sliding carriage 5 is inserted into the guide in the longitudinal direction. Thanks to the described claws 23, 24, which are arranged in accordance with the invention (see also FIGS. 3, 4 and 5), it is sufficient, when the guide grooves 7 extend only along slightly more than the front half of the sliding carriage 5.

For the purpose of assembly, apertures 38, 39 are provided in the guide grooves 7, see FIGS. 6, 7 and 8. The distance 40 between the apertures 38, 39 is equal to the distance between the claws 23, 24 of the housing-fixed guide elements 6. The position of the apertures 38, 39 determines an assembly position, in which the sliding carriage 5 is simply placed onto the housing 1 with the guides 6. The sliding carriage 5 is then displaced rearward by the length of the claws 23, 24, into the operating position, in which it is held in such a way that it can no longer be displaced forward. The sliding carriage can be pushed forward again until it can be lifted off towards the top, only when a non-illustrated dismounting lever is activated.

The invention claimed is:

1. A pistol comprising:

a plastic housing including a grip stock and a trigger guard at a transition to said grip stock;

a sliding carriage containing a barrel and including opposing guide grooves, said sliding carriage extending in a longitudinal direction and being movably connected to said housing;

a locking block made of plastic and connected to said housing said locking block extending forwardly approximately as far as a front end of the trigger guard and including a depression extending in the longitudinal direction;

a pair of guide plates attached to opposing sides of the locking block that are configured to engage said guide grooves of said sliding carriage, wherein the guide plates are connected to the locking block and the housing by a first cross pin and a locking bolt.

2. The pistol according to claim 1, wherein said locking block comprises a fiber-reinforced aramid including glass fibers.

3. The pistol according to claim 1, wherein said locking block is fixed in the housing by said front cross pin and a rear cross pin, and accommodates the locking bolt above the rear cross pin.

4. The pistol according to claim 3, wherein said locking bolt passes through said depression in said locking block, said locking block including a rear wall on which said locking bolt is supported.

5. The pistol according to claim 1, wherein said pair of guide plates each include claws at a front end and a rear end of said pair of guide plates, said claws are bent outwardly away from said locking block and are configured to engage said guide grooves on said sliding carriage.

6. The pistol according to claim 5, wherein said guide grooves extend only along a portion of a length of said sliding carriage, said guide grooves each having apertures at positions corresponding to positions of said claws of said guide plates.

7. The pistol according to claim 1, wherein said guide plates are inserted into depressions formed in side walls of said locking block.

8. The pistol according to claim 5, wherein said guide plates each have a tab positioned between the claws, said tab extending upwardly and configured to laterally guide said sliding carriage.

* * * * *